US005207568A

United States Patent [19]

Szymaszek

[11] Patent Number: 5,207,568

[45] Date of Patent: May 4, 1993

[54] ROTARY SCREW COMPRESSOR AND METHOD FOR PROVIDING THRUST BEARING FORCE COMPENSATION

[75] Inventor: Paul G. Szymaszek, Waukesha, Wis.

[73] Assignee: Vilter Manufacturing Corporation, Milwaukee, Wis.

[21] Appl. No.: 850,504

[22] Filed: Mar. 13, 1992

Related U.S. Application Data

[63] Continuation-in-part of Ser. No. 700,243, May 15, 1991, abandoned.

[51] Int. Cl.[5] ..... F01C 1/16

[52] U.S. Cl. ..... 418/203; 418/1; 418/201.2

[58] Field of Search ..... 418/1, 180, 201.2, 203

[56] References Cited

U.S. PATENT DOCUMENTS

| | | | |
|---|---|---|---|
| 3,275,226 | 9/1966 | Whitfield | 418/203 |
| 4,611,976 | 9/1986 | Schibbye et al. | 418/201.2 |
| 4,678,406 | 7/1987 | Pillis et al. | 418/201.2 |

FOREIGN PATENT DOCUMENTS

| | | | |
|---|---|---|---|
| 2318467 | 10/1974 | Fed. Rep. of Germany | 418/203 |
| 1160111 | 6/1985 | U.S.S.R. | 418/203 |

*Primary Examiner*—Richard A. Bertsch
*Assistant Examiner*—Charles G. Freay
*Attorney, Agent, or Firm*—Nilles & Nilles

[57] ABSTRACT

A rotary compressor is provided that has a housing including a bore, bearings, a low pressure end having a low pressure inlet and a high pressure end having a high pressure outlet. A rotor is rotatably mounted by the bearings in the bore and has an end face subject to a variable axial thrust force; and a plurality of compression chambers having a low pressure, a high pressure and intermediate pressures. A piston is provided for exerting a counterbalancing force on the rotor in opposition to the axial thrust force at the high pressure end of the compressor. An intermediate pressure port is provided in communication with the intermediate pressure chamber. A conduit is connected between the piston and the intermediate pressure port which varies according to suction pressure to cause the piston to apply a variable counterbalance force on the rotor through the output range of the compressor. A method for operating a rotary screw compressor is disclosed comprising the steps of: establishing an intermediate pressure port; operating the compressor to produce a normal working output range and create varying levels of pressure within a series of intermediate pressures; and connecting the intermediate pressure port with the piston to cause the intermediate pressure to appear at the piston and exert a variable counterbalancing force on the rotor corresponding to the variable axial thrust force exerted on the rotor end face.

25 Claims, 6 Drawing Sheets

ROTARY SCREW COMPRESSOR AND METHOD FOR PROVIDING THRUST BEARING FORCE COMPENSATION

CROSS REFERENCE TO RELATED APPLICATION

This application is a continuation-in-part of U.S. application Ser. No. 700,243, filed May 15, 1991, abandoned.

BACKGROUND OF THE INVENTION

1. Field of the Invention

This invention relates to rotary screw compressors, and more particularly to a compressor and a method of operation that will provide automatic compensation against axial thrust forces imposed on the compressor rotor bearings.

2. Description of the Prior Art

Rotary screw compressors comprise a housing with working fluid inlet and outlets, rotor bores and a rotor assembly mounted on bearings for rotation in the rotor bores. The rotor may comprise a single rotor or male and female screw-type rotors having intermeshed lands and grooves. Rotation of the rotor causes a working fluid to be taken from the low pressure inlet or suction side, and gradually compressed in chambers created by the lands and grooves. The high pressure fluid is then discharged through the high pressure outlet.

The capacity of the compressor and the volume ratio of the compressor, sometimes called compression ratio, are controlled by various types of valve arrangements. One type of valve arrangement used to regulate the capacity and volume ratio is termed a slide valve. If a slide valve is used, the compressor housing is provided with a slide valve receiving recess which connects the rotor bores in fluid communication with the low pressure inlet. The slide valve is mounted and operative to either close this recess or open it thereby providing a variable size bypass opening to bypass some compressed fluid back to this inlet to control the compressor capacity.

The volume ratio of the compressor depends upon the period of time fluid remains trapped in the rotor chambers. As the rotors rotate, the rotor chambers become progressively smaller which reduces the volume of the fluid therein and increases its pressure. Therefore, the longer the period of time that fluid remains trapped in the rotor chambers, the smaller its volume becomes. The slide valve is adjustable to regulate the period of time fluid is trapped in the rotor chambers and increasing or decreasing retention time increases or decreases the compressor volume ratio.

An inherent differential pressure $\Delta P$ exists between the low pressure inlet and the high pressure outlet sides of the compressor. This $\Delta P$ pressure acts against the end faces of the rotors and generates axial thrust forces tending to move the rotors toward the low pressure inlet side. These axial thrust forces must be absorbed by the bearings and such forces can generate extremely high axial bearing loads which overload the bearings under many normal operating parameters. However, under other operating parameters very little or no axial thrust force may be generated with the consequence that the bearings are substantially under loaded.

It has long been known that high axial bearing loads produce greater friction and higher operating temperatures on the thrust bearings which greatly reduce their operating life. For example, at face-to-face bearing loads of 10,000 lbs, the bearing life will be under 2000 hours, or less than three months. Replacement of these bearings is extremely expensive in bearing cost, labor cost, and compressor downtime. It has also been known that to guarantee satisfactory performance of both roller and ball bearings, they must always be subject to a given minimum load especially if they run at high speeds such as in compressors where the inertia forces of the bearing elements and cage, and friction in the lubricant, may cause damaging sliding movements to occur between the bearing elements and their raceways. Therefore, both the absence of a minimum load and the presence of a high axial bearing load can damage and drastically shorten the bearing life.

The problem of a short bearing service life in compressors has been recognized for decades and many solutions to solve it have been suggested. The prior art teaches that the high axial thrust forces should be opposed by a counterbalancing force acting in the opposite direction. To accomplish this, U.S. Pat. No. 3,161,349 issued Dec. 15, 1964 to L. B. Schibbye teaches that a counterbalancing piston should be mounted on the rotor in a compartment that is connected to a source of pressurized compressor lubricating oil provided by a pump driven by the compressor. The lubricating oil pressure, in function, reflects the discharge pressure of the compressor and thus generates a counterbalancing force which is a function of the differential pressure $\Delta P$ of the compressor. This counterbalancing piston will exert a force on the bearing that is counter to the axial thrust force. However, as shown in FIG. 4, developing a force that references discharge pressure produces a force WDPT which is a straight line over the output capacity of the compressor as indicated by the 0–100 psia range of suction pressures shown.

Refrigeration and air conditioning compressors are equipped with some type of valve arrangement as previously discussed for varying the capacity of the compressor between maximum and minimum levels. The axial thrust force on the rotor will vary as the capacity of the compressor varies. The resulting axial bearing load at a minimum capacity will be about one-half of the axial bearing load that exists at a maximum capacity. Because, as discussed above, a bearing must always have a minimum loading to prevent failure, a dilemma always exists between two design parameters. First, for long bearing life a counterbalance force applying piston must be sized (areawise) to be as large as possible to offset as much of the axial thrust force as possible at maximum capacity. Second, for long bearing life a counterbalance force applying piston must be sized small enough to prevent overbalancing against the axial thrust force at minimum capacity to prevent underloading the bearing. Therefore, if one sizes the counterbalancing piston to meet the second parameter, there is not enough counterbalancing force at maximum capacity and the bearing life is shortened. If one sizes the counterbalancing piston to meet the first parameter, the bearings will be unloaded at certain minimum capacity conditions and the bearing life is shortened because the required minimum bearing load is not maintained.

This dilemma is illustrated in FIG. 4. Plot FW/OCB (force without counterbalancing) shows that during operation the force varies at maximum capacity from approximately 3920 to 9800 lbs at a constant $\Delta P$ of 100 psi. If one references discharge pressure for counterbalancing, the force WDPT available for counterbalancing is approximately 1335 lbs for a typically sized counterbalancing piston for a particular size rotor no matter what the suction pressure is as long as the ΔP is constant. Therefore, at maximum capacity and 10 psi suction pressure (WR1) the net axial force FDPT-1 available for counterbalancing would be 4400−1335=3065 lbs. The bearing load resulting from this force would result in acceptable bearing life. However, at minimum compressor capacity (FIG. 5), the axial force without counterbalancing would be as shown at WR1 in FIG. 5 and the net bearing load FDPT-1 would be 2200–1335=895 lbs. This loading is far below the bearing manufacturer's recommended minimum load of 2000 lbs and will result in unacceptable bearing life. Referring back again to maximum capacity (FIG. 4), at a 90 psia suction pressure (WR2), the net axial force FDPT-2 would be 9100–1335=7765 lbs. This allows a bearing load that is far too high and would result in a bearing life of less than one year. At minimum compressor capacity (FIG. 5) at 90 psia (WR2), the net bearing load FDPT-2 (from FIG. 5) would be 4550–1335=3215 lbs. This would be an acceptable minimum bearing load.

The following is Table 1 which lists typical values of relevant operating parameters of a compressor of conventional prior art design at ΔP=100 psi wherein discharge pressure of the compressor is sensed and used to provide a pressure for application to a counterbalancing piston. These typical values are for a particular size of standard compressor, balance piston, and bearing arrangement.

TABLE 1

| | ΔP = 100 psi Prior Art (Discharge Pressure) | | | |
|---|---|---|---|---|
| Suction Pressure | 10 | 10 | 90 | 90 |
| Compressor Capacity | Min | Max | Min | Max |
| Axial Force FW/OCB | 2200 | 4400 | 4550 | 9100 |
| Counterbalance Force WDPT | 1335 | 1335 | 1335 | 1335 |
| Net Bearing Load FW/OCB - WDPT | 895 | 3065 | 3215 | 7765 |

There have been many arrangements suggested by the prior art to reduce the adverse effects of these problems. U.S. Pat. No. 3,388,854 issued Jun. 18, 1968 to Olofsson et al uses a spring 35 acting on the thrust bearings. This spring exerts axial thrust on the rotor in the opposite direction to the axial force exerted by the thrust counterbalancing piston to distribute axial thrust more evenly.

U.S. Pat. No. 3,811,805 issued May 21, 1974 to Moody, Jr. et al recognizes that the thrust balance pistons can exert a counterbalancing force that overcompensates for the axial thrust forces. Moody, Jr. et al states that the adverse effects can be overcome by providing a hydrodynamic fluid bearing between the end faces of both female and male screws and a fixed thrust surface of the housing. An oil film is maintained between these two components to reduce wear but this does not fully address the problem of overloading or underloading the bearings.

U.S. Pat. No. 4,180,089 issued Dec. 25, 1979 to Webb also correlates the biasing of the thrust balance pistons to the discharge pressure of the compressor. Webb uses a valve structure in the high pressure lubrication oil line to attenuate the pressure applied to the thrust balance piston so that it will be approximately 20 psi below whatever the compressor discharge pressure is. However, the basic problem of overloading and underloading is not solved.

U.S. Pat. No. Reissue 32,055 issued Dec. 24, 1985 to Schibbye et al discloses that high pressure lubricating oil should be supplied to the thrust balance piston on the low pressure end of the male rotor; that a mean lubricating oil pressure should be applied to the high pressure ends of both the male and female rotors; and that an axial connection passage be provided from the high pressure end of the female rotor to the female rotor balancing piston at the low pressure end thereof to keep both ends at the mean pressure. Thus, the low pressure end of the male rotor is at a high thrust balancing pressure and the low pressure end of the female rotor is at a lower mean thrust balancing pressure to help increase service life of the bearings but does not fully address the problem of underloading and overloading the bearings.

U.S. Pat. No. 4,964,790 issued Oct. 23, 1990 to Scott states that in the prior art "the balancing pressure on the pistons is not responsive to the various operative parameters other than outlet pressure of the rotary compressor." Scott discloses a complex system using a microprocessor control for computing a net counterbalancing force in response to inputs or sensed parameters relating to the pressure of gas at the inlet and outlet of the compressor, and regulates a variable valve of an oil pump responsive to the microprocessor signal to control the amount of thrust balancing oil pressure applied to the counterbalancing pistons.

All of the thrust balancing systems of the prior art are either unduly complex in construction and function and therefore expensive to manufacture and service, or do not supply a counterbalancing force which correlates the axial bearing load through the full range of suction pressures existing between a minimum and maximum compressor working range as illustrated by plots WR1and WR2 of FIGS. 4 and 5.

Therefore, what is needed is a compressor having a simple, reliable, low cost thrust bearing force compensation arrangement and a method for its operation to produce a counterbalancing force correlated to the axial force on the rotors.

SUMMARY OF THE INVENTION

The compressor and method of operation discloses tapping off pressure from the compressor at a preselected point to obtain an intermediate pressure which varies as a function of the suction pressure of the compressor to provide a pressure for application to a counterbalance piston that will produce a force approximately parallel to a plot of the variable axial thrust forces exerted on the bearing. Furthermore, the intermediate pressure will be equal to suction pressure at minimum capacity to reduce the counterbalancing force and ensure adequate minimum bearing loads are maintained.

The rotary compressor according to the present invention comprises a housing including a bore, a bearing means, a low pressure end having a low pressure inlet and a high pressure end having a high pressure outlet. A rotor means is rotatably mounted by the bearing means in the bore and presents a high pressure end face that is subject to axial thrust force induced by high pressure at the high pressure end of the housing. A plurality of compression chamber means is provided on the rotor which successively progressively diminish in volume to provide a low pressure corresponding to the low pressure at the inlet, a high pressure corresponding to the high pressure at the outlet and a series of intermediate pressures which lie between the high and low pressure. Pressure applying means is provided for exerting a counterbalancing force on the rotor in opposition to the axial thrust force existing on the rotor end face at the high pressure end of the compressor during operation. An intermediate pressure port means is provided in equalized pressure communication with the compression chambers means at the intermediate pressures. A conduit means is provided that is connected in equalized pressure communication between the pressure applying means and the intermediate pressure port to cause the pressure applying means to apply a counterbalance force on the rotor which will vary in magnitude according to the intermediate pressure as determined by the equation $$P_2 = P_1 \left( \frac{V_1}{V_2} \right)^k$$

through the output range of the compressor.

More specifically, the compression chambers are formed by intermeshed helical grooves and lands on the rotor with each of the helical grooves having an open end opening onto the end face of the rotor. The low pressure ends and high pressure ends of the compressor are enclosed by suction end casings and high pressure end casings, respectively. The conduit means includes an intermediate pressure port located in the high pressure end casing which is connected in equalized pressure communication with the open ends of the helical grooves that are at an intermediate pressure.

In an alternative embodiment of the invention, the conduit means includes an intermediate pressure port means which is located in the outer periphery of the rotor housing and is in equalized pressure communication with one of the compression chambers that is at the intermediate pressure.

The invention can be used with any type of compressor including those that have a capacity control means for the control of compressor capacity and volume control means for the control of the compressor volume ratio. More specifically, my invention is suitable for use with compressors utilizing a slide valve for capacity and volume ratio control. The use of a slide valve to regulate the amount of fluid that is bypassed back to suction to control capacity and the length of time fluid remains in the rotor chambers to control the volume ratio, is completely compatible with my invention which provides a series of intermediate pressures for causing a pressure applying means to apply a counterbalancing force on the rotor which will vary in magnitude throughout a range of compressor outputs to always maintain the required axial load on the rotor bearings.

The method for operating a rotary screw compressor of the type constructed according to the present invention comprising the steps of: establishing an intermediate pressure port means opening into the chamber means at the intermediate pressure; rotating said compressor means to produce a normal working output range and to create varying levels of the intermediate pressure; connecting the intermediate pressure port in equalized pressure communication with the pressure applying means to cause the varying levels of intermediate pressure to appear at the pressure applying means and exert a counterbalancing force on the rotor means corresponding to the variable axial thrust force exerted on the rotor end face which results in a substantially constant bearing load of a magnitude that satisfies both minimum and maximum bearing load requirements.

The following is Table 2 which lists the identical operating parameters previously used in Table 1 and shows the new values occurring when using the present invention in the same size compressor as that of Table 1 for comparison to the typical values listed in Table 1.

TABLE 2

| | ΔP = 100 psi Intermediate Pressure | | | |
|---|---|---|---|---|
| Suction Pressure | 10 | 10 | 90 | 90 |
| Compressor Capacity | Min | Max | Min | Max |
| Axial Force FW/OCB | 2200 | 4400 | 4550 | 9100 |
| Counterbalance Force WIPT | 0 | 500 | 0 | 5000 |
| Net Bearing Load FW/OCB - WIPT | 2200 | 3900 | 4550 | 4100 |

BRIEF DESCRIPTION OF THE DRAWINGS

Referring to the drawings.

BRIEF DESCRIPTION OF THE PREFERRED EMBODIMENTS

Figure 1:
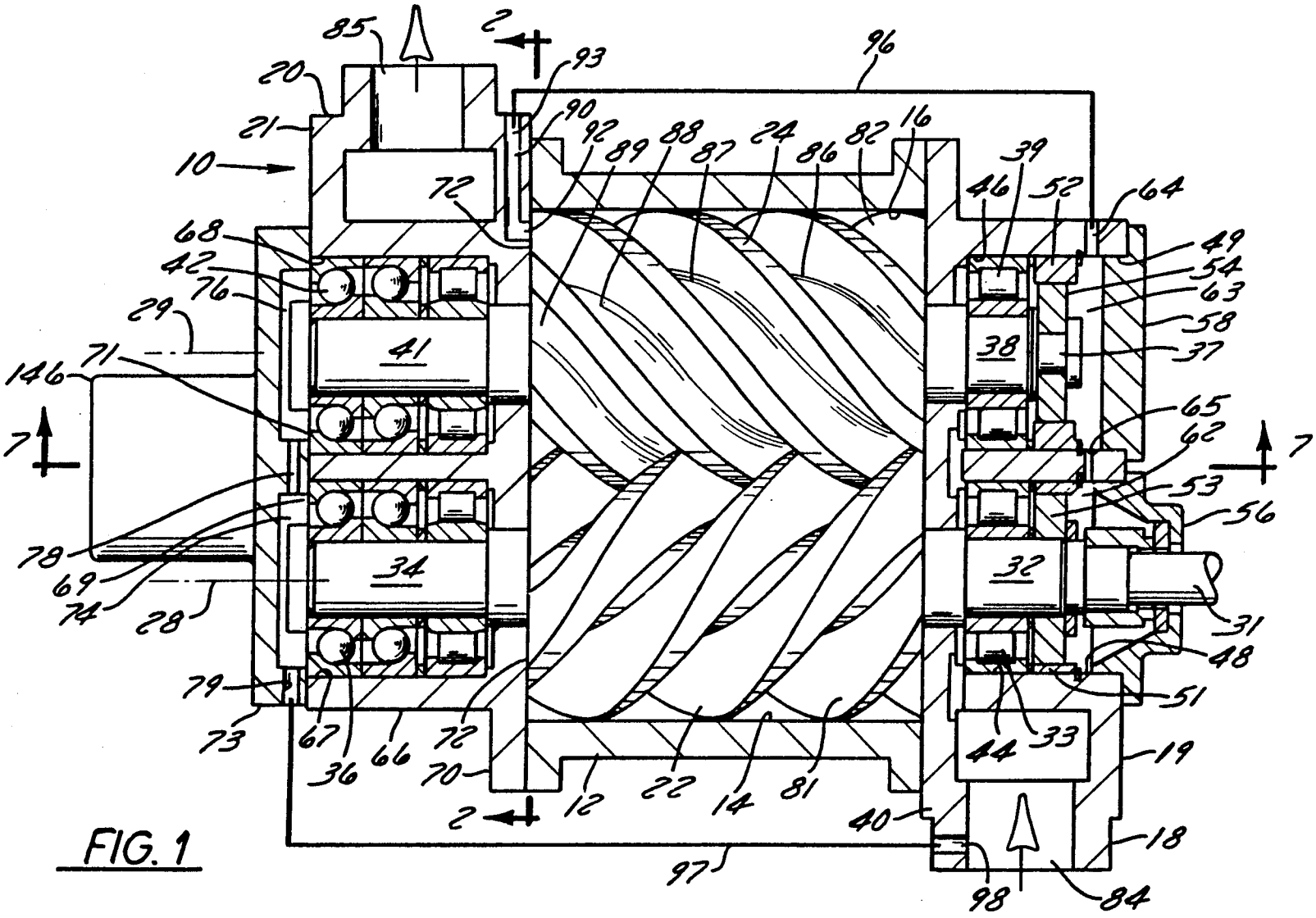
FIG. 1 is a cross-sectional view of a rotary screw compressor constructed according to the present invention.

Referring to FIG. 1, the number 10 identifies a typical rotary screw compressor. The rotary screw compressor 10 includes a rotor housing 12 having intersecting bores 14, 16, a low pressure end 18 enclosed by a suction end casing 19 and a high pressure end 20 enclosed by a high pressure end casing 21. Male and female rotors 22, 24 are rotatably mounted on parallel axes 28, 29 in the housing bores 14, 16. The male rotor 22 includes a shaft 31 having one end 32 mounted in an inlet end bearing means 33 and driven by a motor, not shown. The other end 34 of shaft 31 is mounted by an outlet end bearing means 36. Similarly, the female rotor 24 includes a shaft 37 having one end 38 mounted in an inlet end bearing means 39 and the other end 41 rotatably mounted by an outlet end bearing means 42.

The structure of end casings 19 and 21 will now be described. The suction end casing 19 has an inner portion 40 which includes bores 44, 46 having open ends 48, 49. The male rotor inlet end bearing 33 is mounted in bore 44 and the female rotor inlet end bearing 39 is mounted in bore 46. Counterbalance cylinder sleeves 51, 52 are pressed into bores 44 and 46. Counterbalancing pistons 53, 54 are reciprocally mounted in sleeves 51 and 52 and connected in force transmitting relation to rotor shafts 31 and 37. End caps 56, 58 close the open ends 48, 49 to define pressure chambers 62 and 63. A pressure input passage 64 is provided through suction end casing 19 into chamber 63. An interior passage 65 interconnects the chambers 62 and 63 in open communication with each other.

Referring to the high pressure end 20 of the compressor, high pressure end casing 21 has an inner portion 66 that includes bores 67, 68 having open ends 69 and 71 and a peripheral flange 70 in facing relation to the high pressure end faces 72 of rotors 22, 24. The male rotor outlet end bearing 36 is mounted in bore 67 and the female rotor outlet end bearing 42 is mounted in bore 68. An end cap 73 is mounted on the inner portion 66 of end casing 21 to close open ends 69, 71. The end cap 73 has internal cavities 74, 76 in open facing relation to bearings 36, 42. An interior passage 78 interconnects the cavities 74, 76 in open communication with each other. An output passage 79 is provided through the end cap 73 into open communication with cavities 74 and 76. The output passage 79 is connected by a duct 97 to suction pressure port 98 in end casing 19 to maintain cavities 74 and 76 at suction pressure to reduce some of the load on bearings 36 and 42.

Figure 2:
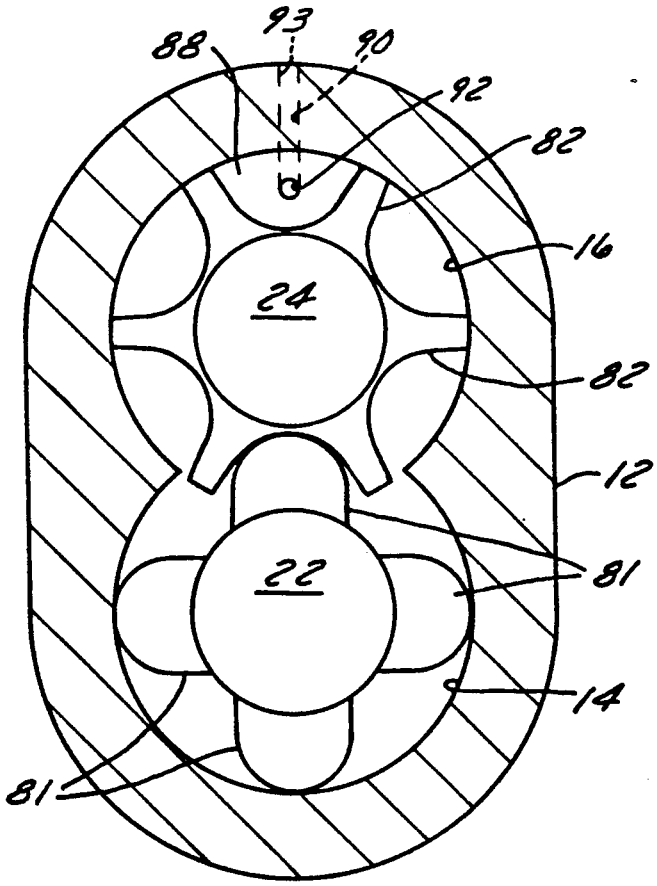
FIG. 2 is a cross section taken along line 2—2 of FIG. 1.
Figure 7:
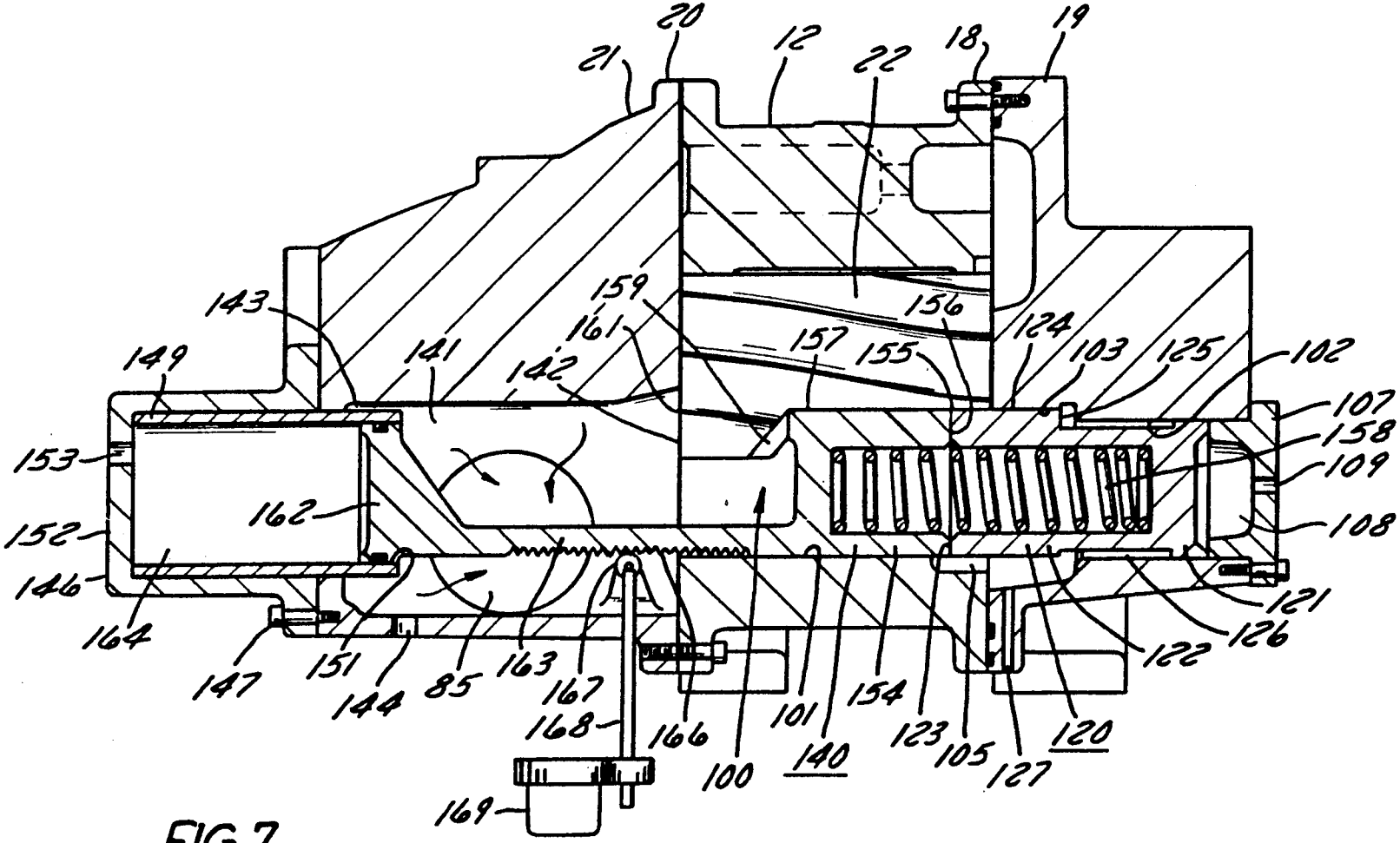
FIG. 7 is a cross section taken along line 7—7 of FIG. 1 showing a capacity and volume ratio control slide valve.

Referring to FIGS. 1 and 2, the male rotor 22 is provided with a plurality of helical lands indicated generally at 81 and the female rotor 24 is provided with a corresponding number of helical grooves indicated generally at 82. The helical lands 81 and grooves 82 intermesh to define a plurality of compression chambers 86, 87, 88 and 89 (FIG. 1) which successively and progressively diminish in volume in known manner as the male and female rotors rotate to provide a high pressure output. The regulation of this output is done by controlling the capacity and volume ratio of the compressor. A slide valve means 100 (FIG. 7) can be provided for such control. Referring to FIG. 7, the slide valve 100 broadly comprises a passive slide valve 120 and an active slide valve 140. The passive and active slide valves 120, 140 and related components for controlling the capacity and volume ratio will now be described.

The housing 12 includes an axially extending slide valve recess 101 which is in fluid communication between the bores 14, 16 and the inlet 84 (FIG. 1) via peripheral opening 105. The suction end casing 19 includes an outer bore 102 of a first diameter and an inner counterbore 103 of a second diameter larger than the first diameter. The end of outer bore 102 is closed by an end cap 107 which defines an outer passive slide chamber 108. End cap 107 also includes a first port 109. The suction end casing 19 further includes the suction pressure or second port 98, as shown in FIG. 1, opening into inlet 84, as previously explained.

The passive slide valve 120 has a piston member 121 slidably mounted in bore 102 and a valve spool 122 slidably mounted in the inner bore 103. The passive slide valve 120 includes a first inner facing end 123 and a peripheral portion 124 on the spool 122 in sealing relation to rotors 22, 24 and which cooperates with bores 102 and 103 to define an inner passive slide chamber 126. Spool 122 has a spool face 125 facing inner chamber 126. A duct 127 connects inner chamber 126 in open fluid communication with inlet 84 and therefore the inner chamber 126 is permanently maintained at suction pressure during operation.

The active slide valve 140 and its related components will now be described. The high pressure discharge end casing 21 is secured to housing 12 by bolts and includes a discharge bore 141 which has interior and outer ends 142, 143, the outlet 85, and a third port 144. The discharge end casing 21 is also provided with an end cap 146 secured in surrounding relation to an opening in the outer end 143 of the discharge bore 141 by cap screws 147. The interior end 142 of the discharge bore 141 is open and faces the ends of rotors 22, 24 to admit compressed fluid such as a gas into the discharge end casing bore 141 for exhaust through outlet 85. The end cap 146 has a cylinder 149 therein presenting an open end 151 facing into the discharge bore 141 and a closed end 152 having a fourth port 153.

The active slide valve 140 is slidably mounted in the recess 101 to move toward and away from the passive slide valve 120. The active slide valve 140 includes a valve spool 154 having a second inner facing end 156 in facing relation to first inner facing end 123 to form a variable and closable gap 155 therebetween and a peripheral portion 157 in sealing relation with rotors 22, 24. A spring 158 may be mounted between the inner facing ends 123, 156. In operation, the ends 123, 156 will be either maintained together in sealing relation or allowed to move toward and away from each other to create the variable gap 155 therebetween that places the bores 14, 16 in fluid communication with inlet 84 via opening 105. The outer end of spool 154 has a discharge end face 159 which is in open facing communication with the discharge bore 141 and moves toward or away from the edge 161 of the outlet casing 21 as active slide valve 140 reciprocates. Therefore, the end of active slide valve 140 presenting the face 159 is permanently exposed to the discharge pressuring during operation.

An active slide valve balancing means in the form of a piston 162, which is mounted for reciprocation in cylinder 149, is connected to the active slide valve 140 by a piston rod 163. Preferably, the piston rod 163 is formed integral with active valve spool 154 and piston 162. Piston 162 and cylinder 149 create an active slide valve chamber 164.

The piston rod 162 includes a gear rack 166 that faces downward, as shown in FIG. 7. A pinion gear 167 is fixedly secured on a pinion drive shaft 168 and meshes with gear rack 166. A reversible rotation motor 169 is connected by a gear train in driving relation to shaft 168. The motor 169 can be activated to reciprocate the active slide valve 140.

The plurality of compression chambers 86, 87, 88 and 89 described above are, at any given point in operating time, at a low pressure corresponding to the pressure at the low pressure inlet 84, a high pressure corresponding to the pressure at the high pressure outlet 85 and at a series of intermediate pressures between said high and low pressures. For example, compression chamber 86 will be at the low pressure; chambers 87 and 88 at the intermediate pressures; and chamber 89 at the high pressure.

Figure 6:
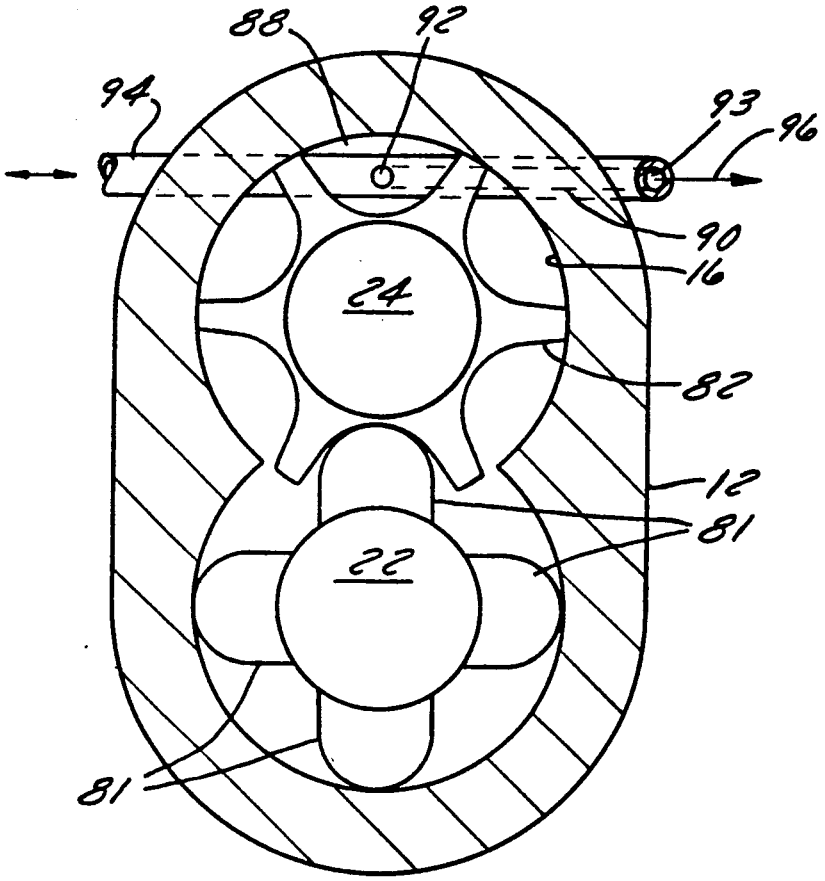
FIG. 6 is a cross section similar to FIG. 2 showing a movable selector means.

Referring to FIGS. 1 and 2, the peripheral flange 70 of the end casing 21 has an intermediate pressure port 90 or tap therein, the pressure of which will vary in magnitude as a function of the suction pressure. The intermediate pressure port 90 has intake portion 92 that opens axially into helical groove 88, which is at an intermediate pressure, and an outtake portion 93 that extends radially outward. The location of the intake portion 92 is by way of example and it may be moved axially or circumferentially to control the timing and duration of the opening. While the intake portion is shown as circular, it could be of any geometric shape such as an arcuate slot or a V-shaped segment. As shown in FIGS. 1 and 2, the intermediate pressure port 90 is at a fixed location in the end casing 21. It is possible to locate the port 90 on a movable selector means 94, as shown in FIG. 6, and to provide an actuating means for moving the selector means to vary the specific location of the intermediate pressure port to select one of the levels of intermediate pressure within the series of intermediate pressures available within the compressor. A conduit means 96 connects port 90 in equalized pressure communicative with passage 64 that opens into counterbalancing chambers 62, 63.

The operation of the slide valve 100 to regulate capacity and discharge pressure will be discussed followed by a discussion of the function of the intermediate pressure port 90.

As previously explained, the inner passive slide valve spool face 125 is permanently exposed to suction pressure via port 127 connected to inner chamber 126. The end face 159 of active slide valve 140 faces discharge bore 141 and therefore is permanently exposed to the discharge pressure that exists in discharge bore 141. With regard to regulation of the volume ratio, if the active slide valve 140 end face 159 is moved to the left toward the discharge edge 161, the gas will be trapped in the rotor groove chambers for a longer period of time, and the volume of gas is reduced as its pressure is increased. This direction of movement of active slide valve 140 to the left results in an increase in volume ratio. Conversely, if the active slide valve end face 159 is moved to the right away from discharge edge 161, the gas will remain trapped for a shorter period of time. Its volume will not be reduced as much because its pressure at time of discharge will be lower. This direction of movement of active slide valve 140 results in a decrease in volume ratio.

In practice, if the compressor is to be operated at full load, the compressor control system, not shown, will connect outer passive slide valve chamber 108 and outer active slide valve chamber 164 to discharge pressure via ports 109, 153 which will force the inner facing ends 123, 156 into abutting sealing engagement. The passive slide valve 120 and active slide valve 140 are now maintained together by discharge pressure and will move as one unit. As the position of the active slide valve 140 is regulated by motor 169, the passive slide valve 120 will automatically follow. As the end face 159 moves closer to or farther from discharge edge 161, the volume ratio is regulated, that is, it is increased or decreased but the capacity of the compressor is not changed.

Compressor capacity will now be discussed. As previously explained, if the end faces 123, 156 are allowed to move apart to create gap 155 therebetween, some of the gas trapped in the rotor compressor chambers can escape and recirculate back to the inlet 84 via opening 105 to reduce capacity. By increasing or decreasing the gap between end faces 123, 156, the capacity can be increased or decreased.

For example, if the compressor is to operate at partial load, the control system will connect passive slide valve outer chamber 108 and active slide valve outer chamber 164 to suction pressure. Therefore, the passive slide 120 and the active slide 140 will no longer be forced together and positive regulation of the active slide valve position by motor 169 is not followed by the passive slide valve 120. In this operating mode, separation can occur which opens the variable gap 155 between inner facing ends 123, 156 that allows more or less gas to recirculate back to the inlet 84 to control the capacity. In actual operation, control of capacity and volume ratio can both occur simultaneously to regulate the operating condition of the compressor.

The operation of the discharge port 90 will now be discussed. During compressor operation, discharge port 90 is in open fluid communication with one of the intermediate pressures existing in the chambers 87, 88 which will vary in magnitude depending upon the magnitude of the suction pressure. The discharge port 90 is always at one of the series of intermediate pressures and never is connected to or references discharge pressure. This varying magnitude intermediate pressure is applied via duct 96 to counterbalancing pistons 53, 54.

Figure 4:
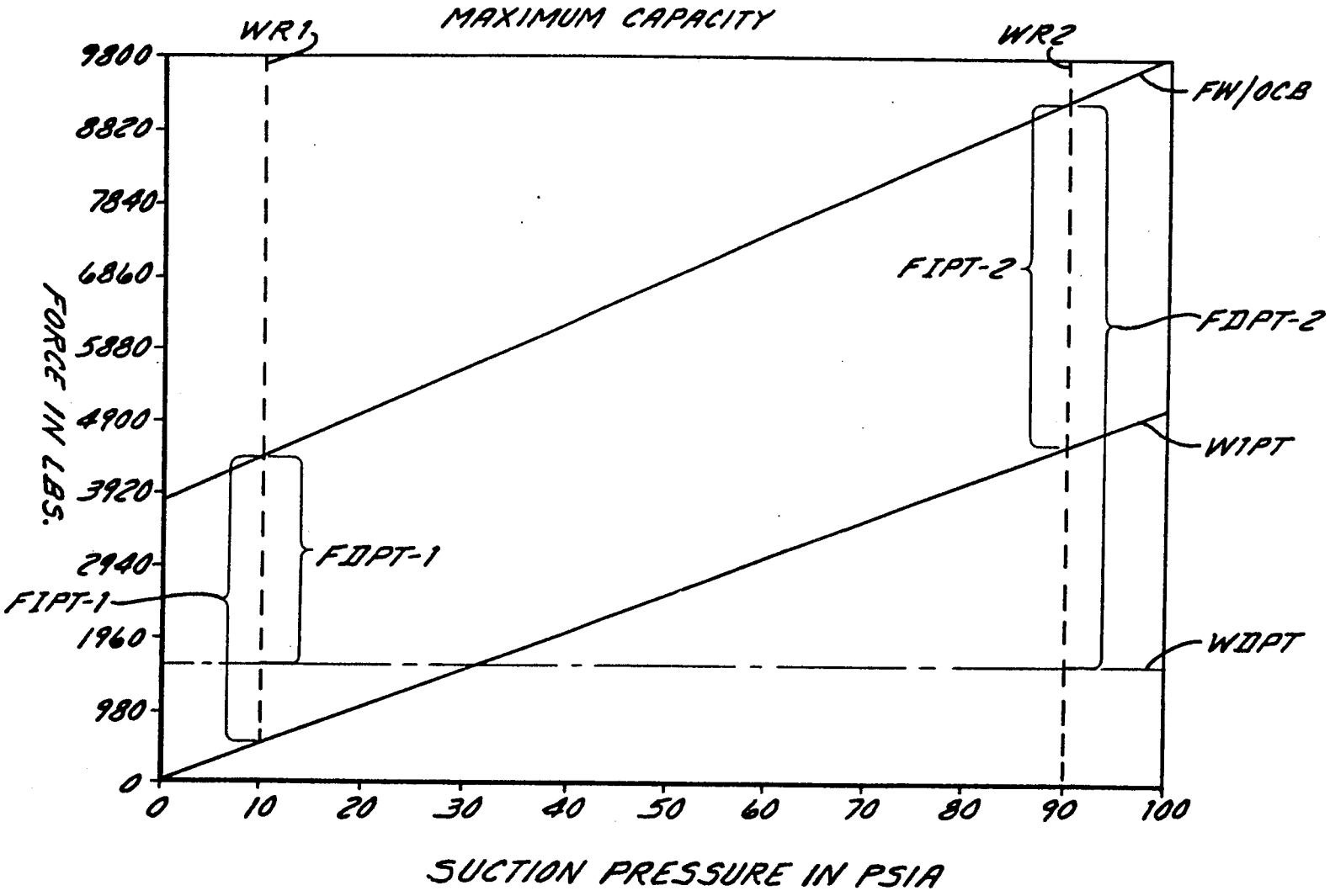
FIG. 4 is a graph showing the axial force in pounds as a function of suction pressure for a discharge pressure tap, an intermediate pressure tap or no pressure tap at maximum capacity for a typical size rotor and conventionally sized balance piston.
Figure 5:
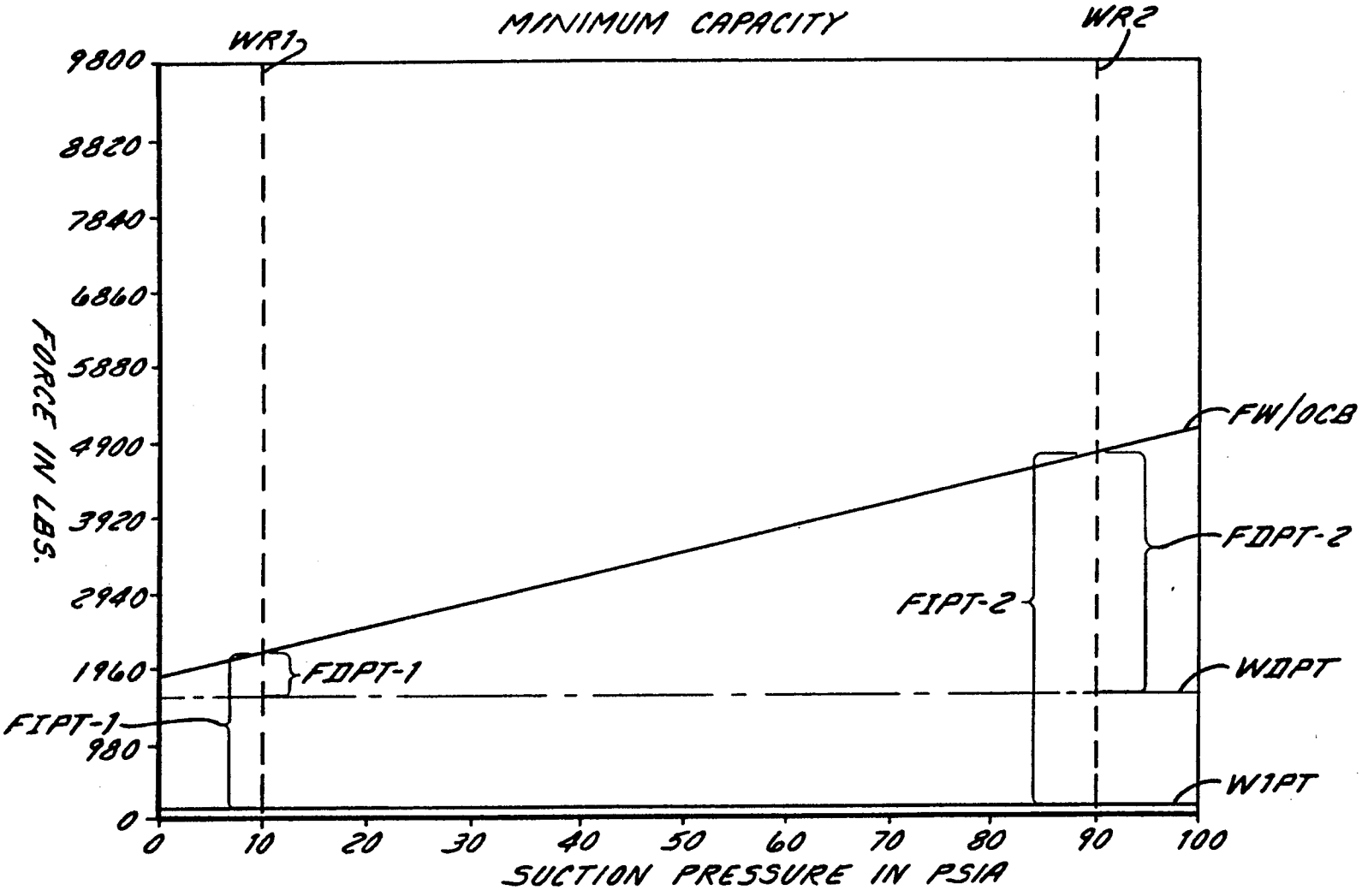
FIG. 5 is a graph showing the axial force in pounds as a function of suction pressure for a discharge pressure tap, an intermediate pressure tap or no pressure tap at a minimum capacity for a typical size rotor and conventionally sized balance piston.

As shown in FIGS. 4 and 5, the axial force in pounds available for application to the counterbalancing pistons 53, 54 will vary in relation to suction pressure shown in psia. FIG. 4 shows plots at maximum capacity and FIG. 5 shows plots at minimum capacity. The typical operating conditions encountered in refrigeration and air conditioning systems can result in a suction pressure range of 0–100 psia and a $\Delta P$ from 100 psi to 250 psi. A normal working or output range would lie between 10 and 90 psia as shown by dash lines WR1 and WR2 in FIGS. 4 and 5. For purposes of explanation, the plots WDPT (with discharge pressure tap), WIPT (with intermediate pressure tap) and FW/OCB (force without any counterbalance) are based on $\Delta P = 100$ psi. However, the inventor has determined that analogous plots exist for a $\Delta P$ of 150, 200 and 250 psi. As FIGS. 4 and 5 show, the axial thrust force is variable, increasing as the suction pressure increases.

The basic requirement, as discussed hereinabove, is to provide a force available for use in axial thrust counterbalancing that will vary to parallel the load curve of the compressor over its full range of outputs and result in longer bearing life. As shown in FIG. 4, providing an intermediate pressure port results in a net bearing load FIPT-1 at maximum capacity developed at low compressor suction pressure WR1 and a net bearing load FIPT-2 at maximum capacity developed at high suction pressure WR2 as being acceptable from a bearing life standpoint. As shown in FIG. 5, the pressure at port 90, normally at some intermediate pressure, is reduced to suction pressure at minimum compressor capacity through operation of the slide valve 160 which results in an acceptably low counterbalancing force FIPT-1 which is essentially zero and which is significantly lower than the force FDPT-1 exists when the discharge pressure is used for counterbalancing as taught in the prior art. The net axial bearing loads that exist during low and high suction pressures at minimum and maximum compressor capacities resulting from use of a counterbalancing force related to either discharge pressure, as taught in the prior art, or intermediate port pressure, as taught by the present invention are summarized hereinabove in TABLES 1 and 2. TABLES 1 and 2 enable a comparison of bearing loads when counterbalancing is referenced to discharge pressure, as taught in the prior art, with bearing loads resulting from counterbalancing referenced to a variable intermediate pressure as taught by the present invention. As is shown in TABLE 2, both an acceptable maximum bearing load and acceptable minimum bearing load are obtained and maintained with the improved system using an intermediate pressure port 90.

For example, referring to TABLE 1, when the compressor operates at minimum capacity without the use of an intermediate pressure port referenced to suction pressure, the net bearing load at a suction pressure of 10 pounds will only be 895 pounds which is below the recommended minimum bearing load as specified by the bearing manufacturer.

Referring to TABLE 2, with the use of the present invention, the set bearing load will be 2200 pounds which is an acceptable minimum bearing load.

At maximum compressor capacity, without the use of the intermediate pressure port, the net bearing load as shown in TABLE 1 is 7765 pounds, which is unacceptably high. The use of the intermediate pressure port as shown in TABLE 2 reduces the high bearing load to 4100 pounds which will result in a substantial increase in bearing life.

Further, these improved results are achieved with a simple, low cost, maintenance-free structure that does not require the use of complex, expensive microprocessing systems, attenuating pressure valves or the like.

The method of operating a compressor constructed according to my invention comprises: establishing an intermediate pressure port 90 into one of said compressor chambers 87, 88 that is at the intermediate pressure; rotating the rotor means in a normal working output range (i.e. from low to high suction pressures) and creating varying levels of intermediate pressures; and connecting the intermediate pressure port 90 in equalized pressure communication with the pressure applying means 53, 54 to cause said varying levels of intermediate pressure to appear at said pressure applying counterbalancing pistons 53, 54 and exert a counterbalancing force on the rotors 22, 24 corresponding to the variable axial thrust force exerted on the end faces 72 whereby the rotor bearings will not be overbalanced or underbalanced during operation of the compressor over its working output range. During operation, the maximum and minimum capacities as illustrated will be obtained by operating slide valve 100.

Figure 3:
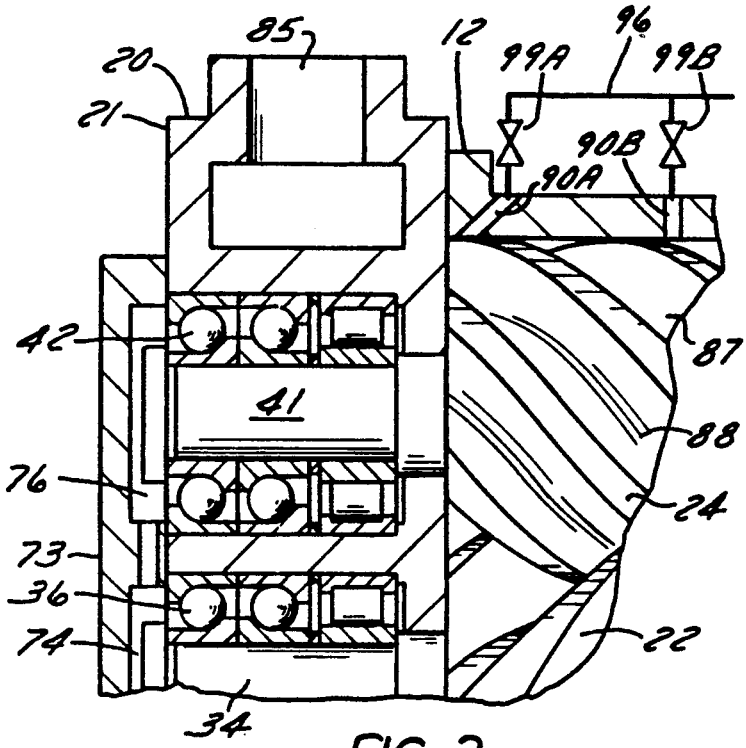
FIG. 3 is an enlarged partial view of FIG. 1 showing a second embodiment of the invention.

In the embodiment of FIG. 3, the location of intermediate pressure port 90A is moved from the high pressure end casing 21 to the housing 12. Also as shown, providing a plurality of intermediate pressure ports 90A, 90B is within the scope of the invention. While two ports 90A, 90B are shown, more could be provided. The ports 90A, 90B are controlled by selector means in the form of valves 99A, 99B. One of the valves 99A or 99B will be opened to enable the operator to select the precise intermediate pressure level desired for operation. All other elements of the compressor of the second embodiment are constructed and arranged the same as those of the first embodiment. Therefore, no further explanation of the construction of the compressor of the second embodiment will be made. The method of operation of the compressor of the second embodiment will be exactly the same as described with regard to the first compressor. The configuration and location of ports 90A, 90B is by way of example. The geometric shape of ports 90A, 90B may be varied or their location may be moved axially or circumferentially, or they may be placed on a movable selector member, such as selector means 94 shown in FIG. 6, provided the desired intermediate pressure is obtained.

What is claimed is:

1. A rotary screw compressor comprising:

a rotor housing including a bore means, a bearing means, a low pressure end having a low pressure inlet and a high pressure end having a high pressure outlet;

rotor means rotatably mounted by said bearing means in said bore means, and having a high pressure end face subject to a variable axial thrust force induced by high pressure at said high pressure end;

a compression chamber means on said rotor means which successively progressively diminishes in volume during operation to provide a low pressure corresponding to said low pressure at said inlet, a high pressure corresponding to said high pressure at said outlet and a series of intermediate pressures between said high and low pressures throughout a range of the compressor outputs;

a pressure applying means for exerting a counterbalancing force on said rotor means in opposition to said variable axial thrust force existing on said rotor means end face at said high pressure end during operation;

an intermediate pressure port means in equalized pressure communication with said compression chamber means at one of said series of intermediate pressures; and a conduit means in equalized pressure communication between said pressure applying means and said intermediate pressure port means to supply said one of said series of intermediate pressures to said pressure applying means and cause application of a variable counterbalancing force on said rotor means which varies through said output range of the compressor.

2. A rotary screw compressor according to claim 1, wherein said compressor further includes a capacity and volume ratio means for regulating said output range of the compressor.

3. A rotary screw compressor according to claim 2, wherein capacity and volume ratio means includes: a slide valve receiving recess in said rotor housing providing a fluid bypass between said bore means and said low pressure inlet; a slide valve mounted in said recess to either close said bypass or open said bypass to create a variable volume opening for bypassing fluid back to said inlet and provide a minimum to maximum compressor capacity range; a slide valve actuating means for moving said slide valve to provide a compressor volume ratio range; said capacity and volume ratio means creating said series of intermediate pressures in said conduit means to cause said pressure applying means to apply a variable counterbalancing force on said rotor means that will always maintain a required axial load on said bearing means throughout said compressor output range.

4. A rotary screw compressor according to claim 1 wherein:

said compressor chamber means includes a plurality of compression chambers formed by intermeshed helical grooves and lands on said rotor means that are at said high, low and said series of intermediate pressures, said helical grooves each having an open end opening onto said rotor end face;

said low pressure end is enclosed by a suction end casing, and said high pressure end is enclosed by a high pressure end casing; and said intermediate pressure port means is in said high pressure end casing in equalized pressure communication with said open end of one of said helical grooves that is at said intermediate pressure.

5. A rotary screw compressor according to claim 4 wherein said high pressure end casing includes a peripheral flange in facing relation to said rotor high pressure end face and overlying said helical groove end openings; and said intermediate pressure port means is in said peripheral flange.

6. A rotary screw compressor according to claim 5 wherein said intermediate pressure port means has an intake portion opening axially into said helical groove and an outtake portion extending radially outward of said flange.

7. A rotary screw compressor according to claim 1 wherein said intermediate pressure port means is in said rotor housing and opens into equalized pressure communication with one of said compression chambers that is at said intermediate pressure.

8. A rotary screw compressor comprising:

a rotor housing including a bore means, a bearing means, a low pressure end having a low pressure inlet and a high pressure end having a high pressure outlet;

rotor means rotatably mounted by said bearing means in said bore means, and having a high pressure end face subject to a variable axial thrust force induced by high pressure at said high pressure end;

a compression chamber means on said rotor means which successively progressively diminishes in volume during operation to provide a low pressure corresponding to said low pressure at said inlet, a high pressure corresponding to said high pressure at said outlet and a series of intermediate pressures between said high and low pressures throughout a range of the compressor outputs;

a pressure applying means for exerting a counterbalancing force on said rotor means in opposition to said variable axial thrust force existing on said rotor means end face at said high pressure end during operation;

an intermediate pressure port means in equalized pressure communication with said compression chamber means at one of said series of intermediate pressures; and a conduit means in equalized pressure communication between said pressure applying means and said intermediate pressure port means to supply said one of said series of intermediate pressures to said pressure applying means and cause application of a variable counterbalancing force on said rotor means which varies through said output range of the compressor, wherein said intermediate pressure port means includes a plurality of intermediate pressure ports connectable in equalized pressure communication with said compressor chamber means at different intermediate pressure levels within said series of intermediate pressures, and wherein a selector means is provided for connecting only one of said intermediate pressure ports with said conduit means.

9. A rotary screw compressor comprising:

a rotor housing including a bore means, a bearing means, a low pressure end having a low pressure inlet and a high pressure end having a high pressure outlet;

rotor means rotatably mounted by said bearing means in said bore means, and having a high pressure end face subject to a variable axial thrust force induced by high pressure at said high pressure end;

a compression chamber means on said rotor means which successively progressively diminishes in volume during operation to provide a low pressure corresponding to said low pressure at said inlet, a high pressure corresponding to said high pressure at said outlet and a series of intermediate pressures between said high and low pressures throughout a range of the compressor outputs;

a pressure applying means for exerting a counterbalancing force on said rotor means in opposition to said variable axial thrust force existing on said rotor means end face at said high pressure end during operation;

an intermediate pressure port means in equalized pressure communication with said compression chamber means at one of said series of intermediate pressures; and a conduit mean sin equalized pressure communication between said pressure applying means and said intermediate pressure port means to supply said one of said series of intermediate pressures to said pressure applying means and cause application of a variable counterbalancing force on said rotor means which varies through said output range of the compressor, wherein said intermediate pressure port means comprises a movable selector means, a single port on said movable selector means, and an actuating means for moving said selector means to vary the specific location of said intermediate pressure port to select one of the intermediate pressures within said series of intermediate pressures.

10. A rotary screw compressor comprising:

a rotor housing having intersecting bores, a bearing means, a low pressure end having a low pressure inlet and a high pressure end having a high pressure outlet;

male and female rotors rotatably mounted by said bearing means on parallel axes in said bores, and each having a high pressure end face subject to a variable axial thrust force induced by high pressure at said high pressure end;

helical grooves and lands on said rotors intermeshed to define a plurality of compression chambers which successively progressively diminish in volume during operation to provide compression chambers that have a low pressure corresponding to said low pressure at said inlet, a high pressure corresponding to said high pressure at outlet and a series of intermediate pressures between said high and low pressures throughout a range of the compressor outputs;

a pressure applying means for exerting a counterbalancing force on at least one of said rotors in opposition to said axial thrust force existing on said rotor end face at said high pressure end during operation;

an intermediate pressure port means in equalized pressure communication with one of said compression chambers that is at a pressure falling within said series of intermediate pressures; and a conduit means in equalized pressure communication between said pressure applying means and said intermediate pressure port means to cause said pressure applying means to apply a counterbalancing force on said rotor which varies as a function of suction pressure to maintain a required axial bearing load on said bearing means throughout said output range of the compressor.

11. A rotary screw compressor according to claim 10, further comprising a slide valve receiving recess in said rotor housing providing a fluid bypass between said bore means and said low pressure inlet; a slide valve mounted in said recess to either close said bypass or open said bypass to create a variable volume opening for bypassing fluid back to said inlet and provide a minimum to maximum compressor capacity range; a slide valve actuating means for moving said slide valve to provide a range of volume ratios for said compressor, said slide valve creating said series of intermediate pressures in said conduit means causing said pressure applying means to apply a variable counterbalancing force on said rotor means to always maintain a required axial load on said bearing means throughout said compressor output range.

12. A rotary screw compressor according to claim 10 wherein:

said high pressure end is enclosed by a high pressure end casing; and said helical grooves each have an open end opening onto said rotor end face;

said intermediate pressure port means is in said high pressure end casing in equalized pressure communication with said open end of one of said helical grooves that is at one of said intermediate pressures.

13. A rotary screw compressor according to claim 12 said high pressure end casing includes a peripheral flange in facing relation to said rotor high pressure end face and overlying said helical groove end openings; and said intermediate pressure port means is in said peripheral flange.

14. A rotary screw compressor according to claim 13 wherein said intermediate pressure port means has an intake portion opening axially into said helical groove and an outtake portion extending radially outward of said flange.

15. A rotary screw compressor according to claim 10 wherein said intermediate pressure port means is adjacent said high pressure end of the compressor housing.

16. A rotary screw compressor comprising:

a rotor housing having intersecting bores, a bearing means, a low pressure end having a low pressure inlet and a high pressure end having a high pressure outlet;

male and female rotors rotatably mounted by said bearing means on parallel axes in said bores, and each having a high pressure end face subject to a variable axial thrust force induced by high pressure at said high pressure end;

helical grooves and lands on said rotors intermeshed to define a plurality of compression chambers which successively progressively diminish in volume during operation to provide compression chambers that have a low pressure corresponding to said low pressure at said inlet, a high pressure corresponding to said high pressure at outlet and a series of intermediate pressures between said high and low pressures throughout a range of the compressor outputs;

a pressure applying means for exerting a counterbalancing force on at least one of said rotors in opposition to said axial thrust force existing on said rotor end face at said high pressure end during operation;

an intermediate pressure port means in equalized pressure communication with one of said compression chambers that is at a pressure falling within said series of intermediate pressures; and a conduit means in equalized pressure communication between said pressure applying means and said intermediate pressure port means to cause said pressure applying means to apply a counterbalancing force on said rotor which varies as a function of suction pressure to maintain a required axial bearing load on said bearing means throughout said output range of the compressor;

wherein said intermediate pressure port means comprises a plurality of intermediate pressure ports in said rotor housing each opening into equalized pressure communication with one of said compression chambers that is at a pressure falling within said series of intermediate pressures and wherein a selector means is provided to select only one of said intermediate pressure ports for connection to said conduit means during operation of said compressor.

17. A method for operating a rotary screw compressor of the type including a rotor housing having a bore means, a bearing means, a low pressure inlet end, and a high pressure outlet end; a rotor means rotatably mounted in said bore means by said bearing means and having a plurality of compression chamber means which successively progressively diminishes in volume to provide a low pressure corresponding to the pressure at said inlet end, a high pressure corresponding to the pressure at said outlet end and a series of intermediate pressures between said low and high pressures, and a high pressure end face subject to said high pressure at said outlet end which exerts a variable axial thrust force on said rotor means corresponding to compressor output; and a pressure applying means connected to said rotor means to exert a counterbalancing force on said rotor means comprising the steps of:

establishing an intermediate pressure port means opening into said compression chamber means at one of said series of intermediate pressures;

rotating said rotor means to operate said compressor in an output range and create a source of said series of intermediate pressures; and connecting said intermediate pressure port means in equalized pressure communication with said pressure applying means to allow said one of said series of intermediate pressures to appear at said pressure applying means and exert a varying counterbalancing force on said rotors which will parallel the load curve of the compressor from minimum to maximum operating capacity to always provide a required axial load on said bearing means.

18. A method for operating a rotary screw compressor of the type including a rotor housing having a bore means, a bearing means, a low pressure inlet end, and a high pressure outlet end; a rotor means rotatably mounted in said bore means by said bearing means and having a plurality of compression chamber means which successively progressively diminishes in volume to provide a low pressure corresponding to the pressure at said inlet end, a high pressure corresponding to the pressure at said outlet end and a series of intermediate pressures between said low and high pressures, and a high pressure end face subject to said high pressure at said outlet end which exerts a variable axial thrust force on said rotor means corresponding to compressor output; and a pressure applying means connected to said rotor means to exert a counterbalancing force on said rotor means comprising the steps of:

establishing an intermediate pressure port means opening into said compression chamber means at one of said series of intermediate pressures;

rotating said rotor means to operate said compressor in an output range and create a source of said series of intermediate pressures; and connecting said intermediate pressure port means in equalized pressure communication with said pressure applying means to allow said one of said series of intermediate pressures to appear at said pressure applying means and exert a varying counterbalancing force on said rotors which will parallel the load curve of the compressor rom minimum to maximum operating capacity to always provide a required axial load on said bearing means;

establishing a plurality of intermediate pressure ports into said intermediate pressure means at locations therein that will result in a different one of said intermediate pressures appearing at each port;

connecting any selected one of said plurality of intermediate pressure ports in equalized pressure communication with said pressure applying means; and preventing intermediate pressure flow from the remaining intermediate pressure ports.

19. A method for operating a rotary screw compressor of the type including a rotor housing having a bore means, a bearing means, a low pressure inlet end, and a high pressure outlet end; a rotor means rotatably mounted in said bore means by said bearing means and having a plurality of compression chamber means which successively progressively diminishes in volume to provide a low pressure corresponding to the pressure at said inlet end, a high pressure corresponding to the pressure at said outlet end and a series of intermediate pressures between said low and high pressures, and a high pressure end face subject to said high pressure at said outlet end which exerts a variable axial thrust force on said rotor means corresponding to compressor output; and a pressure applying means connected to said rotor means to exert a counterbalancing force on said rotor means comprising the steps of:

establishing an intermediate pressure port means opening into said compression chamber means at one of said series of intermediate pressures;

rotating said rotor means to operate said compressor in an output range and create a source of said series of intermediate pressures; and connecting said intermediate pressure port means in equalized pressure communication with said pressure applying means to allow said one of said series of intermediate pressures to appear at said pressure applying means and exert a varying counterbalancing force on said rotors which will parallel the load curve of the compressor from minimum to maximum operating capacity to always provide a required axial load on said bearing means;

establishing said intermediate pressure port means on a movable member that is movable to vary the location of said intermediate pressure port means; and moving said movable member to place said intermediate pressure port means in equalized pressure communication with a selected one of said varying pressures within said intermediate pressure range.

20. A rotary screw compressor comprising:

a rotor housing including a bore means, a bearing means, a low pressure end having a low pressure inlet, a high pressure end having a high pressure outlet, and a slide valve recess providing a fluid bypass between said bore means and said inlet;

rotor means rotatably mounted by said bearing means in said bore means, and having a high pressure end face subject to a variable axial thrust force induced by high pressure at said high pressure end;

a compression chamber means on said rotor means which successively progressively diminishes in volume during operation to provide a low pressure and a high pressure throughout a range of compressor outputs, and which is capable of providing a series of intermediate pressures capable of progressively increasing between said high and low pressures;

a slide valve means mounted in said slide valve recess operative to control compressor capacity and compression volume ratio through said compressor output range;

a pressure applying means for exerting a counterbalancing force on said rotor means in opposition to said variable axial thrust force existing on said rotor means end face at said high pressure end during operation;

an intermediate pressure port means in equalized pressure communication with said compression chamber means at one of said series of intermediate pressures; and a conduit means in equalized pressure communication between said pressure applying means and said intermediate pressure port means to supply said one of said series of intermediate pressures to said pressure applying means and cause application of a counterbalancing force on said rotor means which varies through said compressor output range to always maintain a required axial load on said bearing means.

21. A rotary screw compressor comprising:

a rotor housing including a bore means, a bearing means, a low pressure end having a low pressure inlet, a high pressure end having a high pressure outlet, and a slide valve recess providing a fluid bypass between said bore means and said inlet;

rotor means rotatably mounted by said bearing means in said bore means, and having a high pressure end face subject to a variable axial thrust force induced by high pressure at said high pressure end;

a compression chamber means on said rotor means which successively progressively diminishes in volume during operation to provide a low pressure and a high pressure throughout a range of compressor outputs, and which is capable of providing a series of intermediate pressure capable of progressively increasing between said high and low pressures;

a slide valve means mounted in said slide valve recess operative to control compressor capacity and compression volume ratio through said compressor output range;

a pressure applying means for exerting a counterbalancing force on said rotor means in opposition to said variable axial thrust force existing on said rotor means end face at said high pressure end during operation;

an intermediate pressure port means in equalized pressure communication with said compression chamber means at one of said series of intermediate pressures; and a conduit means in equalized pressure communication between said pressure applying means and said intermediate pressure port means to supply said one of said series of intermediate pressures to said pressure applying means and cause application of a counterbalancing force on said rotor means which varies through said compressor output range to always maintain a required axial load on said bearing means;

wherein said intermediate pressure port means includes a plurality of intermediate pressure ports connectable in equalized pressure communication with said compressor chamber means at different intermediate pressure levels within said series of intermediate pressures, and wherein a selector means is provided for connecting only one of said intermediate pressure ports with said conduit means.

22. A rotary screw compressor comprising;

a rotor housing including a bore means, a bearing means, a low pressure end having a low pressure inlet, a high pressure end having a high pressure outlet, and a slide valve recess providing a fluid bypass between said bore means and said inlet;

rotor means rotatably mounted by said bearing means in said bore means, and having a high pressure end face subject to a variable axial thrust force induced by high pressure at aid high pressure end;

a compression chamber means on said rotor means which successively progressively diminishes in volume during operation to provide a low pressure and a high pressure throughout a range of compressor outputs, and which is capable of providing a series of intermediate pressure capable of progressively increasing between said high and low pressures;

a slide valve means mounted in said slide valve recess operative to control compressor capacity and compression volume ratio through said compressor output range;

a pressure applying means for exerting a counterbalancing force on said rotor means in opposition to said variable axial thrust force existing on said rotor means end face at said high pressure end during operation;

an intermediate pressure port means in equalized pressure communication with said compression chamber means at one of said series of intermediate pressures; and a conduit means in equalized pressure communication between said pressure applying means and said intermediate pressure port means to supply said one of said series of intermediate pressures to said pressure applying means and cause application of a counterbalancing force on said rotor mean which varies through said compressor output range to always maintain a required axial load on said bearing means;

wherein said intermediate pressure port means comprises a movable selector means, a single port on said movable selector means, and an actuating means for moving said selector means to vary the specific location of said intermediate pressure port to select one of the intermediate pressures within said series of intermediate pressures.

23. A rotary screw compressor comprising:

a rotor housing including a bore, a low pressure end having a low pressure inlet, and a high pressure end having a high pressure outlet;

a rotor rotatably mounted in said bore and having a high pressure end face subject to a variable axial thrust force induced by high pressure at said high pressure end, said rotor defining first and second pressure chambers presenting a low pressure corresponding to said low pressure at said inlet and a high pressure corresponding to said high pressure at said outlet, respectively, said rotor further defining a third pressure chamber which is positioned between said first and second pressure chambers and which is capable of presenting an intermediate pressure between said high and low pressures;

a pressure applying device capable of exerting a counterbalancing force on said rotor in opposition to said variable axial thrust force existing on said rotor end face at said high pressure end during operation;

an intermediate pressure port in equalized pressure communication with said third compression chamber; and a conduit in equalized pressure communication between said pressure applying device and said intermediate pressure port so as to be capable of supplying said intermediate pressure to said pressure applying device and of causing application of a variable counterbalancing force on said rotor.

24. A rotary screw compressor according to claim 23, further comprising a slide valve which is provided in said housing and which regulates an output range of said compressor from minimum to maximum values.

25. A rotary screw compressor according to claim 24, wherein said slide valve includes passage which communicates said compression chamber at said portion capable of providing said intermediate pressure and which, when said slide valve regulates said output range of said compressor to said minimum value, communicates with said low pressure inlet.

* * * * *